US006203295B1

(12) United States Patent
Nishioka

(10) Patent No.: US 6,203,295 B1
(45) **Date of Patent: *Mar. 20, 2001**

(54) INK-JET RECORDING DEVICE AND PUMP USED THEREIN

(75) Inventor: Atsushi Nishioka, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/546,923

(22) Filed: Apr. 11, 2000

Related U.S. Application Data

(63) Continuation of application No. 08/890,265, filed on Jul. 9, 1997, now Pat. No. 6,082,977.

(30) Foreign Application Priority Data

Jul. 11, 1996 (JP) ..... 8-182534
Jul. 1, 1997 (JP) ..... 9-176226

(51) Int. Cl.[7] ..... F04B 43/08
(52) U.S. Cl. ..... 417/476; 417/477.8
(58) Field of Search ..... 417/476, 477.7, 417/477.8

(56) References Cited

U.S. PATENT DOCUMENTS

| | | |
|---|---|---|
| 419,461 | 1/1890 | Lee . |
| 2,314,281 | 3/1943 | Knott . |
| 2,696,173 | 12/1954 | Jensen . |
| 3,737,256 | 6/1973 | De Vries . |
| 4,976,593 | 12/1990 | Miyamoto . |

FOREIGN PATENT DOCUMENTS

| | | |
|---|---|---|
| 0 499 484 | 8/1992 | (EP) . |
| 2 722 139 | 1/1996 | (FR) . |
| 6-286158 | 10/1994 | (JP) . |
| 7-217541 | 8/1995 | (JP) . |

*Primary Examiner*—Charles G. Freay
(74) *Attorney, Agent, or Firm*—Mark P. Watson

(57) ABSTRACT

A pump 15 disposed in an ink-jet recording device has flexible tube 103 and guide member 106 whereon a prescribed part of the tube is mounted. Roller 105, of which there is at least one and which pressurizes and deforms tube 103, is supported by lever 107 such that it pressurizes the tube when it rotates in the forward direction and releases the pressure on the tube when it rotates in the reverse direction. This lever 107 is urged by spring 108 in the direction that presses the roller against the tube.

16 Claims, 15 Drawing Sheets

INK-JET RECORDING DEVICE AND PUMP USED THEREIN

CROSS REFERENCE TO RELATED APPLICATIONS

This application is a continuation of Application Ser. No. 08/890,265, filed Jul. 9, 1997, now U.S. Pat. No. 6,082,977 which is incorporated by reference herein in its entirety.

BACKGROUND OF THE INVENTION

1. Field of the Invention

This invention relates to an ink-jet recording device that records on a recording medium by ejecting ink from nozzles, and more specifically it relates to the structure of a pump disposed in part of an ink supply path that supplies ink to the nozzles or in an ink discharge path that discharges ink from the nozzles.

2. Description of the Related Art

In ink-jet recording devices of the prior art, recovery devices are often proposed for returning the ink-jet head to a normal condition when the ink has become thick near the nozzles or if there are bubbles in the nozzles. Certain of these recovery devices employ a means for covering the nozzles with a cap, driving a pump disposed in the ink discharge path connected to the cap for withdrawing or discharging ink from the nozzles using pressure (negative pressure) generated by the pump.

To supply ink to the nozzles from the ink tank, there is also a supply device with a pump disposed in the ink supply path that links the tank and nozzles and supplies ink using the pressure generated by the pump.

In the pumps used in this kind of recovery device and supply device, there is a tube pump proposed that comprises a flexible tube disposed in an arc along a guide and a rotor supporting a roller which pressurizes the flexible tube and that generates pressure using deformation of the tube. In this kind of tube pump, rotation of the rotor causes the roller to sequentially squeeze the flexible tube, whereby pressure is generated inside the tube.

Japanese Laid-Open Patent Application 6-286158 discloses a tube pump wherein the rollers pressurize the tube when the rotor is rotated in the forward direction and relieves the pressure of the roller on the tube when turned in the reverse direction. The shaft of the roller of this tube pump is fitted in a channel in the body of the rotor, and depending on the direction of rotation of the rotor, the roller shaft moves to one or the other end of the channel. Due to the difference in the distance from each end of the channel to the center of the rotor, the roller moves forward or back each time the direction of rotation is changed.

A tube pump is disclosed in Japanese Laid-Open Patent Application 4-261864 wherein the roller is pushed against the tube by a spring, whereby the tube is deformed and pressurized by the pressure exerted by this spring.

The tube pumps described above, however, present the following problems.

In the pump disclosed in Japanese Laid-Open Application 6-286158, the amount with which the roller squeezes (intrudes on) the tube is affected by the distance from the center of the rotor to the shaft of the roller at one end of the channel, the roller diameter, the shape of the arc-shaped guide for mounting the tube, the tube wall thickness and the accuracy with which these parts are attached. Therefore, even if parts are used that are not completely desirable from a tolerance standpoint with respect to the dimensional accuracy and assembly accuracy of these parts, there must be no space in the tube (tube must be completely squeezed) where the roller pressurizes it in order for the pump to be effective.

Therefore, a large motor with a large output is used to drive the rotor so that the motor will have enough torque even if the roller should intrude too far, which can result from fluctuations in the amount the roller intrudes due to limits in the accuracy of the parts and their assembly accuracy. This is disadvantageous from the perspective of increased cost as well as increased size of the motor.

In the tube pump disclosed in Japanese Laid-Open Patent Application 4-261864, a configuration is employed that uses a spring to urge the roller which squeezes the tube, and therefore it is possible to avoid having to increase the torque to drive the pump.

However, since the roller is continually urged by the spring and presses against the tube in this kind of tube pump, it causes certain problems. That is, in this kind of pump, when the roller is positioned so that it pressurizes the tube on the arc-shaped guide, pressure is continually applied to the tube and the tube becomes deformed. If the roller is left in this condition for long periods, then plastic deformation occurs in the tube and the tube deteriorates and becomes damaged. Therefore, when the pump is not operating, the roller must be continually parked in a position away from the tube on the guide. This requires a photo sensor or other type of detector to determine the position of the roller (i.e., pump phase). The addition of the photo sensor or other detection means increases cost and makes the pump larger.

OBJECTS OF THE INVENTION

The present invention is intended to solve these problems, and its purpose is to offer a tube pump wherein the power that drives the pump is small in spite of fluctuations to a certain degree in the manufacturing accuracy of the tube and the other components making up the pump and their assembly accuracy, whereby the motor torque for driving the pump can be small and the tube life is extended.

Its purpose is also to offer a highly reliable ink-jet recording device with a compact tube pump that generates a high negative pressure and is capable of thoroughly recovering the recording head to a normal condition.

SUMMARY OF THE INVENTION

According to this invention, the ink-jet recording device of the present invention is equipped with a pump disposed in part of the ink supply path that supplies ink to the nozzles or in the ink discharge path that discharges ink from the nozzles and that generates pressure by sequentially pressurizing and deforming a flexible tube by means of a roller disposed on a rotor, and the pump has the following features.

Part of the flexible tube is mounted on the arc-shaped guide and the flexible tube is deformed by being sandwiched between the guide and the roller. The roller is supported such that it can move on a lever that is pivotally supported on the rotor. For example, the lever has a groove, and by inserting the shaft of the roller in this groove, the roller is allowed to move along the groove between the ends of the groove. The shape of this groove is inclined with respect to the circumference of the rotor, and therefore the roller moves, depending on the direction of rotation, toward or away from the tube mounted on the guide. That is, when the rotor rotates forward, the roller moves to a first position where it pressurizes the tube, and when the rotor rotates in the reverse direction, the roller moves to a second position where the pressure applied to the tube is relieved. Also, the lever is biased toward the guide by a torsion spring, for example, and the tube is pressurized by the roller at the first position due to the elastic force of the spring.

By this mechanism, the amount the roller squeezes (intrudes on) the tube is determined by the elastic force of the spring, and therefore increased drive torque of the pump due to fluctuations in part accuracy or assembly accuracy can be avoided, thus making it possible to achieve a pump with a low drive torque.

When the rotor rotates in the forward direction, the roller moves to the first position where it sequentially squeezes the tube and generates a pressure in the tube. After stopping the rotor when the pump is stopped, the rotor rotates in the reverse direction a prescribed amount, whereby the roller moves to the second position. When the roller is in the second position, the pivot movement of the lever is inhibited by a lever inhibiting means such that the lever being urged by the spring will not pivot any further. This relieves the pressure of the roller on the tube, and the roller is in a state wherein it only lightly contacts the tube, whereby the problem of plastic deformation or deterioration of the tube is alleviated. Also, there is no need for a detector to determine the position of the roller in order to solve this kind of problem.

By providing two or more rollers and a plurality of levers to support each roller as described above and positioning the rollers such that there is always at least one roller positioned continually on the front surface of the arc-shaped guide, the pump efficiency can be improved because the pressure generated can be accumulated. That is, the pressure generated by sequentially squeezing the tube with the roller is increased rather than being allowed to return to the atmospheric pressure when the roller moves away from the tube at one end.

However, by providing a valve that closes the tube when the roller is at the position where it moves away from the tube on the guide, an efficient pump can be achieved with just one roller.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

The configuration of the ink-jet recording device in an embodiment of the present invention is described with reference to FIG. 1 to FIG. 3 and FIG. 9.

Figure 1:
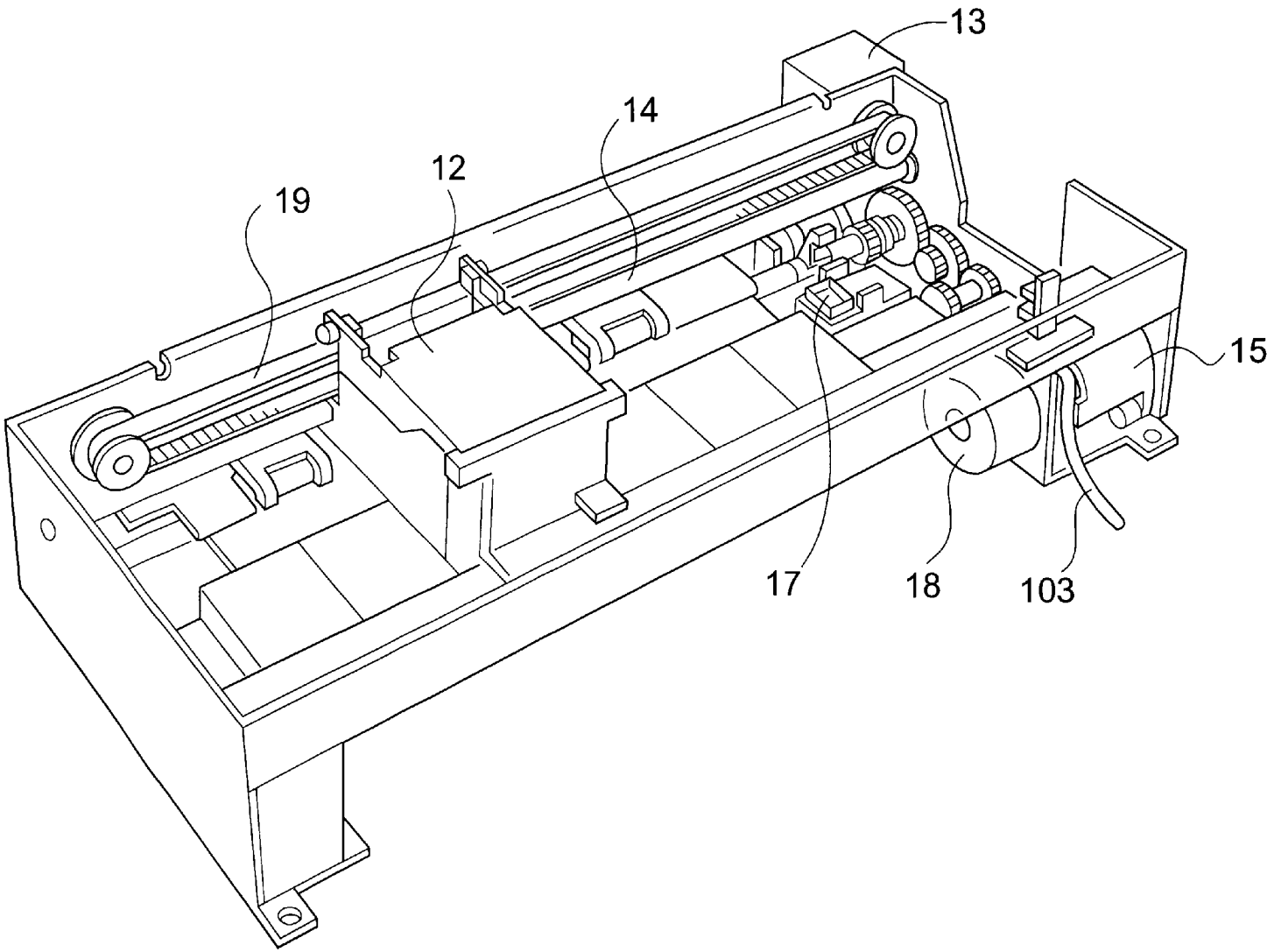
FIG. 1 is a perspective view showing an overall configuration of the ink-jet recording device of the present invention.

FIG. 1 is a schematic representation of the ink-jet recording device of an embodiment of the invention. Recording head 11 (shown in FIG. 9) is mounted on carriage 12, and it is guided by guide shaft 14 and moved by carriage motor 13 via belt 19. Cap 17 is used to cap nozzles 11A (shown in FIG. 9) of recording head 11. Flexible tube 103, which is a component of tube pump 15, is connected to cap 17. Tube pump 15 is driven by pump motor 18.

Figure 9:
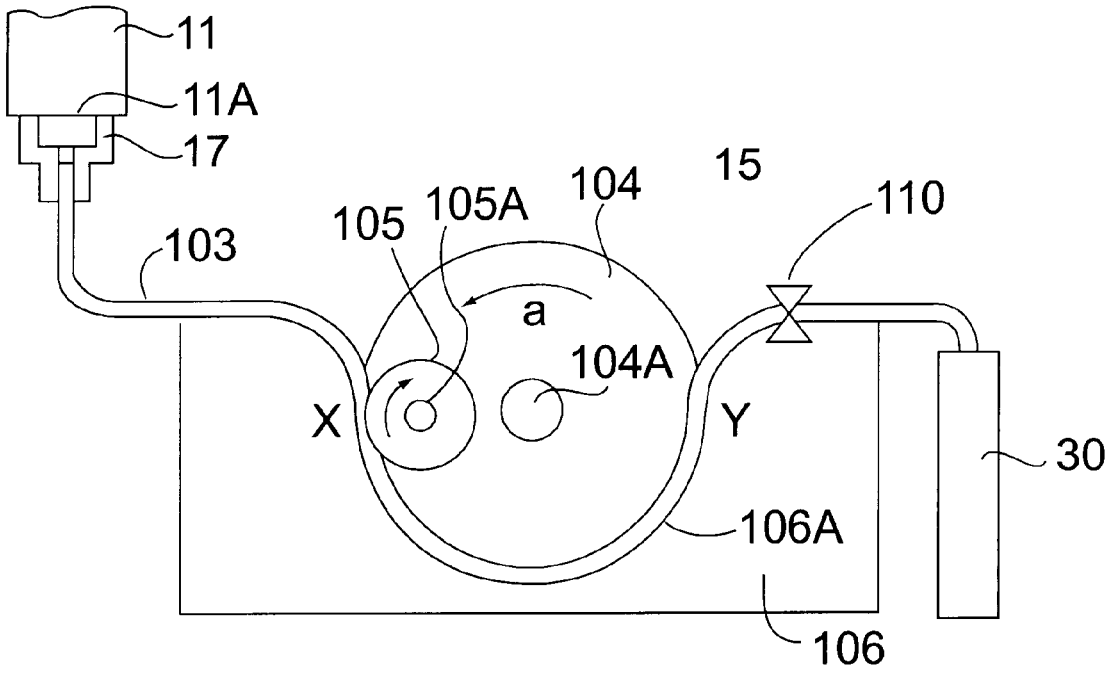
FIG. 9 is an explanatory diagram depicting the operation of tube pump 15 of the present invention.

FIG. 9 is an explanatory diagram showing an outline of the operation of tube pump 15. Tube 103 forms the ink discharge path, and its one end is connected to cap 17 while the other end is connected to waste ink tank 30. By rotating rotor plate 104 around shaft 104a in the direction of arrow a, roller 105 sequentially pressurizes tube 103 mounted on arc-shaped guide 106A while it rotates in the b direction. This action deforms the tube, and ink in nozzles 11A is pulled via the cap by the negative pressure or suction generated in tube 103, whereby unneeded ink is discharged in the waste ink tank. In this embodiment, an example is described wherein a pump is disposed in part of the ink discharge path, but the invention is not limited to this, and it is also applicable to a pump disposed in the ink supply path that links the ink supply tank and the recording head 11.

Figure 2:
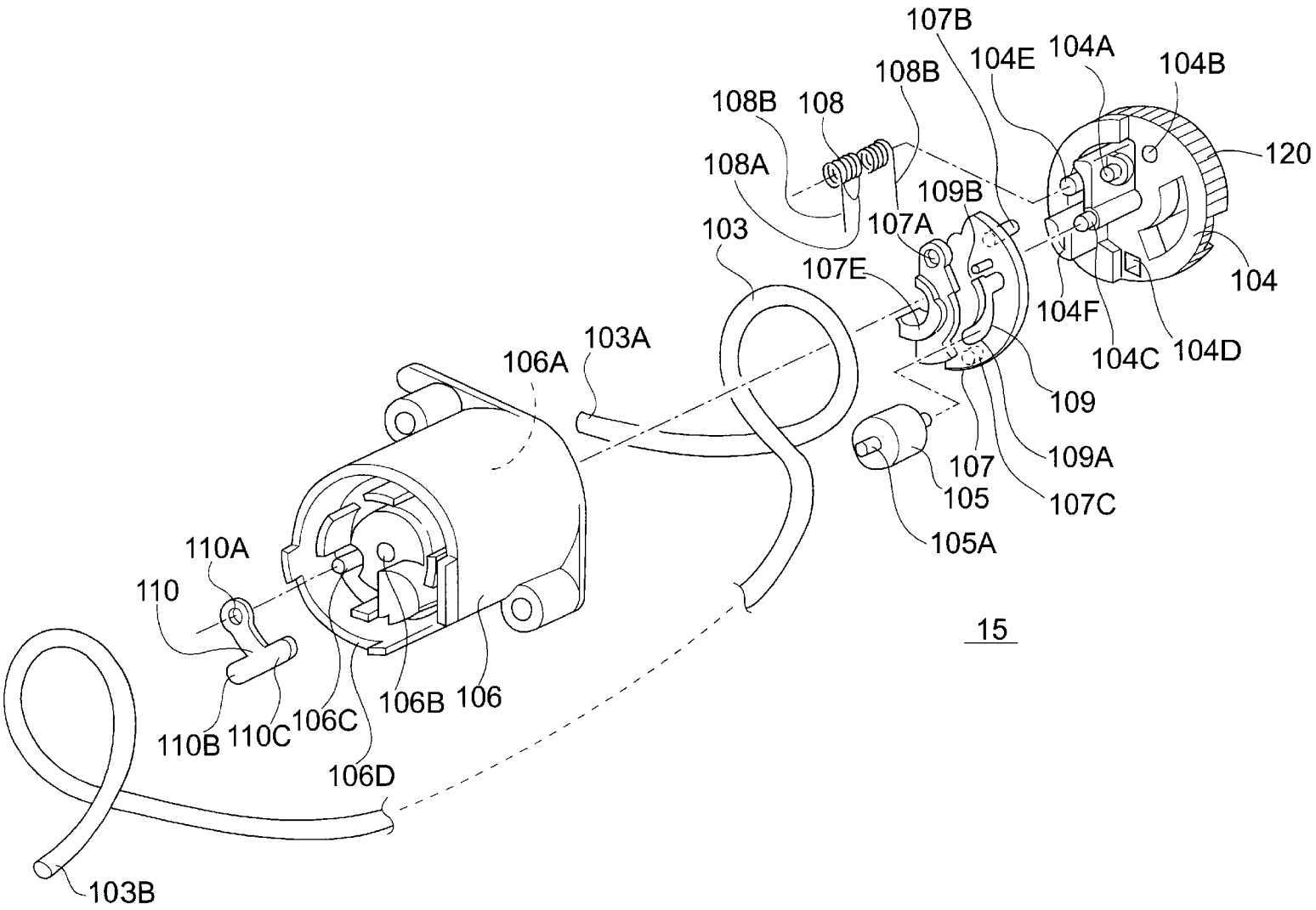
FIG. 2 is an exploded view showing the configuration of an embodiment of the tube pump of the ink-jet recording device of the present invention.
Figure 3:
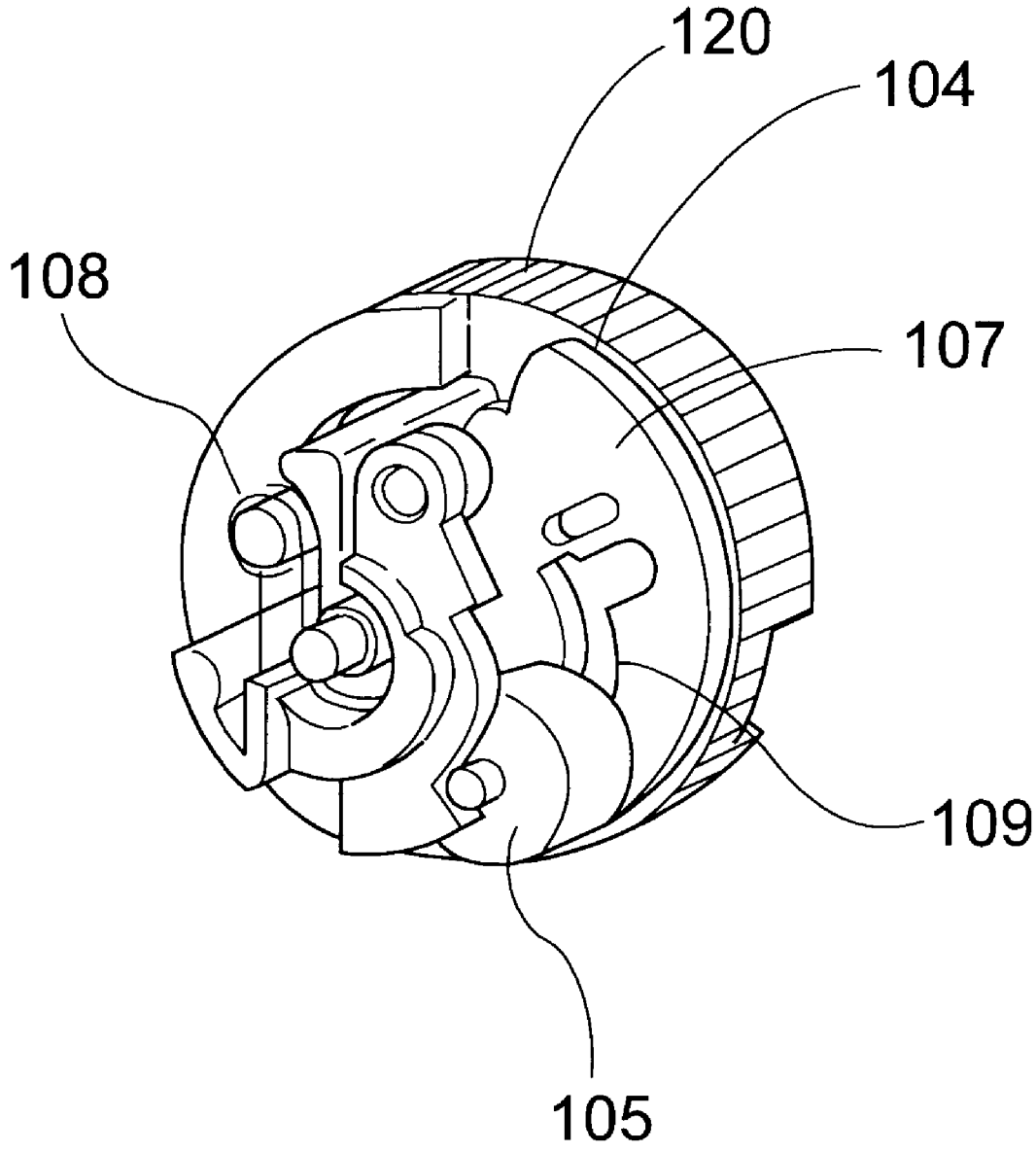
FIG. 3 is a perspective view showing the principal parts of the tube pump of the embodiment shown in FIG. 2.

FIG. 2 is a an exploded perspective drawing showing the configuration of tube pump 15 in the ink-jet recording device in FIG. 1, and FIG. 3 is an assembly perspective drawing showing the principal parts of tube pump 15 in FIG. 2.

Tube pump 15 comprises guide member 106, tube 103, roller 105, lever 107, rotor plate 104 and torsion spring 108.

Tube 103 has flexibility at least in the area where it is pressurized by roller 105. The area subject to being pressurized is mounted on arc-shaped guide surface 106A (shown best in FIG. 4) formed on the inside wall of cylindrical-shaped guide member 106 such that tube 103 is sequentially pressurized by roller 105. End 103A of tube 103 is connected to the cap. End 103B is connected to the waste ink tank after being guided by arc-shaped guide 106D on the bottom side of guide member 106.

Shaft member 105A of roller 105 is received in groove-shaped cam 109 of lever 107 such that it is able to rotate. Groove-shaped cam 109 in which shaft member 105A of the roller is received is disposed in lever 107 to support roller 105. With lever 107 installed in rotor plate 104, this cam 109 has an inclined shape with respect to the circumference of the rotor plate 104. That is, the distance from the center of rotor plate 104 to one end of cam groove 109 is less than the distance of the center of rotor plate 104 to the other end of cam groove 109.

Pivot hole 107A and pivot shaft 107B are disposed on the same pivot axis on lever 107, and shaft 104A disposed on rotor plate 104 is inserted in pivot hole 107A while pivot shaft 107B is inserted in hole 104B disposed in rotor member 104. By this mechanism, lever 107 is attached to rotor plate 104 such that it can pivot about the pivot axis.

Stopper pin 107C (shown best in FIG. 4) for regulating the pivot movement of lever 107 within a fixed range is disposed on the surface of lever 107 on the side facing the rotor plate. Level 107 is biased by torsion spring 108 to pivot toward the outside circumference of rotor plate 104. The stopper pin 107C is inserted in stopper hole 104D of rotor plate 104, and the contact of stopper pin 107C on the side walls of hole 104D regulates the pivot movement of lever 107 to a certain range.

A double-torsion type spring is used as torsion spring 108, and the coil part of the spring is fitted around the outside of cylindrical shaft 104E disposed on the rotor plate. Spring 108 is installed on rotor plate 104 such that arm 108B of torsion spring 108 is in contact with spring stopper 104F disposed on rotor plate 104 and the other arm 108A of spring 108 is in contact with spring stopper 107D (shown in FIG. 4) of lever 107.

Figure 4:
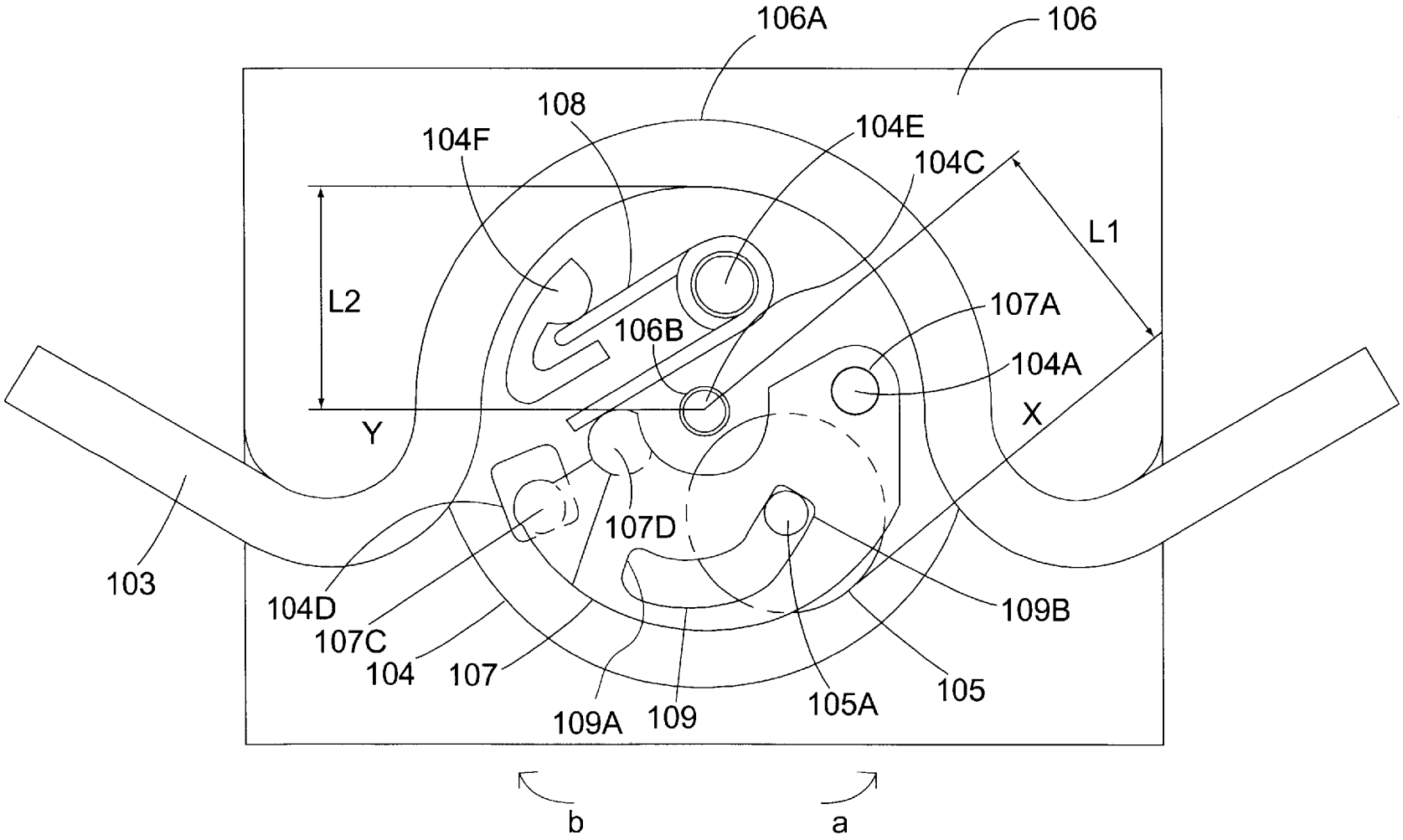
FIG. 4 is a cross section of part of lever 107 of the tube pump shown in FIG. 2, and it shows roller 105 in the hold position where it is stopped away from guide 106A.

FIG. 4 is a cross section of part of lever 107 of the pump shown in FIG. 2.

End 109A of groove-shaped roller cam 109 is the farthest part of the cam curve from rotor shaft 104C of rotor plate 104, and when shaft 105A of the roller is positioned at end 109A (first position; referred to as operation position below), tube 103 is pressurized by roller 105. The other end 109B of groove-shaped roller cam 109 is the closest part of the cam curve to rotor shaft 104C of rotor plate 104, and when shaft 105A of the roller is positioned at end 109C (second position; referred to as hold position below), the pressure applied to tube 103 is relieved.

When rotor 104 rotates in the forward direction (a direction), roller 105 moves along cam curve 109 of lever 107 to the operation position, and when rotor 104 rotates in the reverse direction (b direction), roller 105 moves to the hold position.

When the roller is in the operation position and it sequentially pressurizes the tube, stopper pin 107C moves away from the side wall of hole 104D and the tube is pressurized by the elastic force of spring 108. Spring 108 has been selected to have a sufficient amount of elastic force to close the space in the tube in the pressurized area of tube 103.

When the roller is in the hold position, however, stopper pin 107C comes in contact with the side wall of hole 104D and stops the pivot movement of lever 107, whereby roller 105 is prevented from pressurizing tube 103. Regardless of the direction of rotation of rotor plate 104, the pivot movement of lever 107 is inhibited by stopper pin 107C even when roller 105 has moved away from arc-shaped guide 106A as shown in FIG. 4.

As shown in FIG. 4, the distance L1 from the center of rotor shaft 104C of rotor plate 104 to the outer circumference of roller 105 when roller 105 is in the hold position is set such that it has the following relationship to the distance L2 from the center of rotor shaft 104 to the inner surface of tube 103 in guide surface 106:

$$\text{Distance L1} > \text{Distance L2} \quad (1)$$

Figure 8:
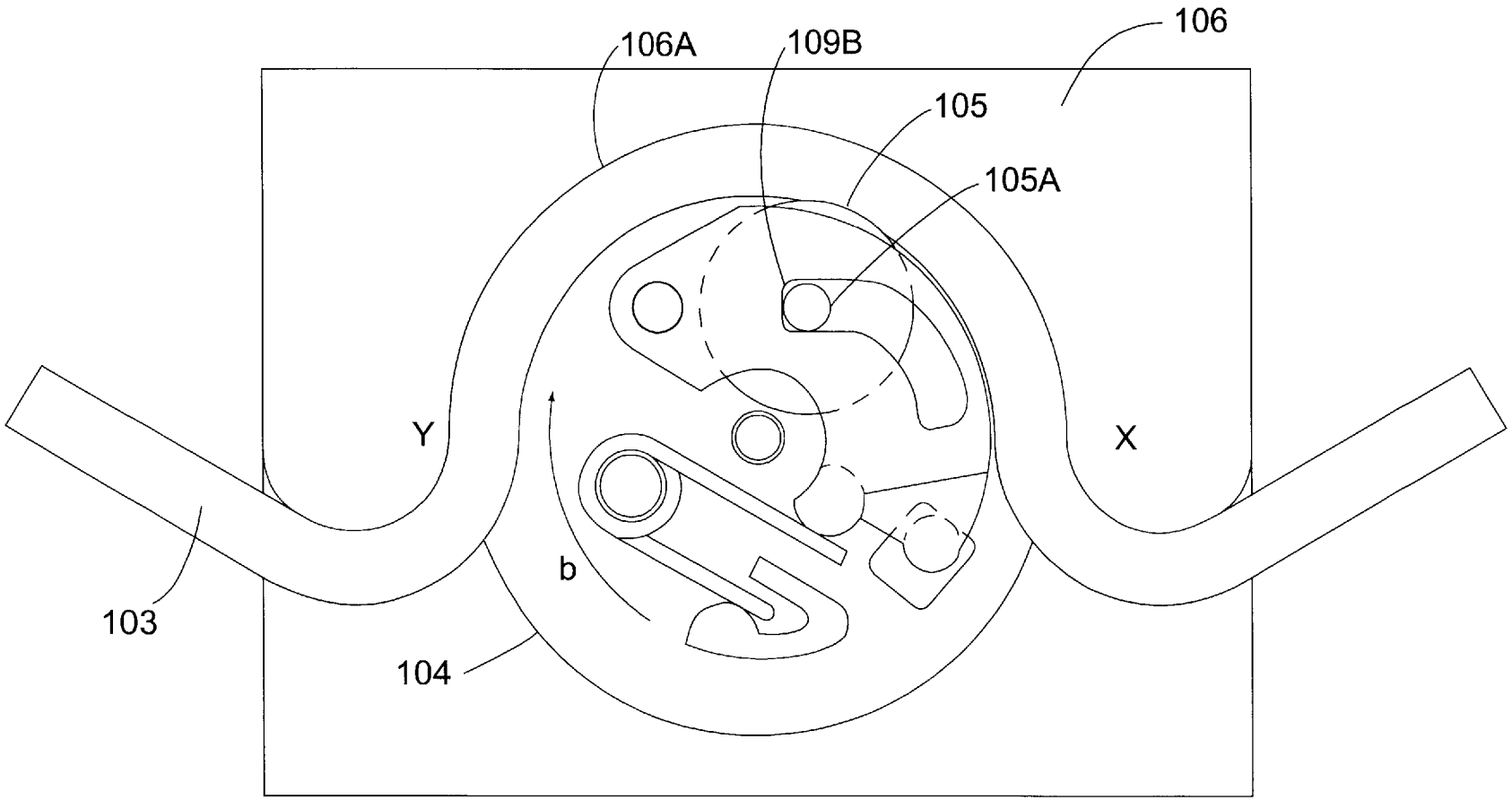
FIG. 8 is a cross section of part of lever 107 of the tube pump shown in FIG. 2, and it shows the pump in a state wherein it rotates in the reverse direction and roller 105 is in a hold position in which it contacts tube 103 only lightly.

That is, even if roller 105 is in the hold position, the pressure in the tube is not completely relieved and the roller stays in contact with the tube (see FIG. 8). However, the stopper pin location is set such that sufficient space remains inside the tube in the area where roller 105 comes in contact with the tube.

As shown in FIG. 2, rotor plate 104 is attached such that it can rotate about shaft 104C with respect to cylindrical guide member 106. Gear 120 is integrally formed on the outside circumference of rotor plate 104, and by action of driving pump motor 18 (shown in FIG. 1), rotor plate 104 is rotated in the forward and reverse directions via an idle gear (not shown) coupled to gear 120.

Hole 106B for receiving shaft 104C of the rotor member is formed in guide member 106. Tube 103 is guided along guide 106D on the side of guide member 106 opposite to the side on which rotor plate 104 is mounted. T-shaped valve 110 which also functions to close tube 103 is attached to this surface of guide member 106 such that it can rotate around shaft 106C disposed on guide member 106. Hole 110A of valve 110 enables attachment of the valve to shaft 106C of guide member 106.

Cam 107E for operating the valve is disposed on lever 107, and when roller 105 is at a position separated from guide 106A (see FIG. 4, for example), cam 107E pushes the end of arm 110C of valve 110, which causes the end of arm 110B to squeeze tube 103. By this mechanism, even if the roller is at a position where it does not pressurize the tube during pump operation, the inside of tube 103 is not released to the atmosphere.

Next, the operation of the tube pump of this embodiment is described with reference to FIG. 4 to FIG. 8.

Figure 5:
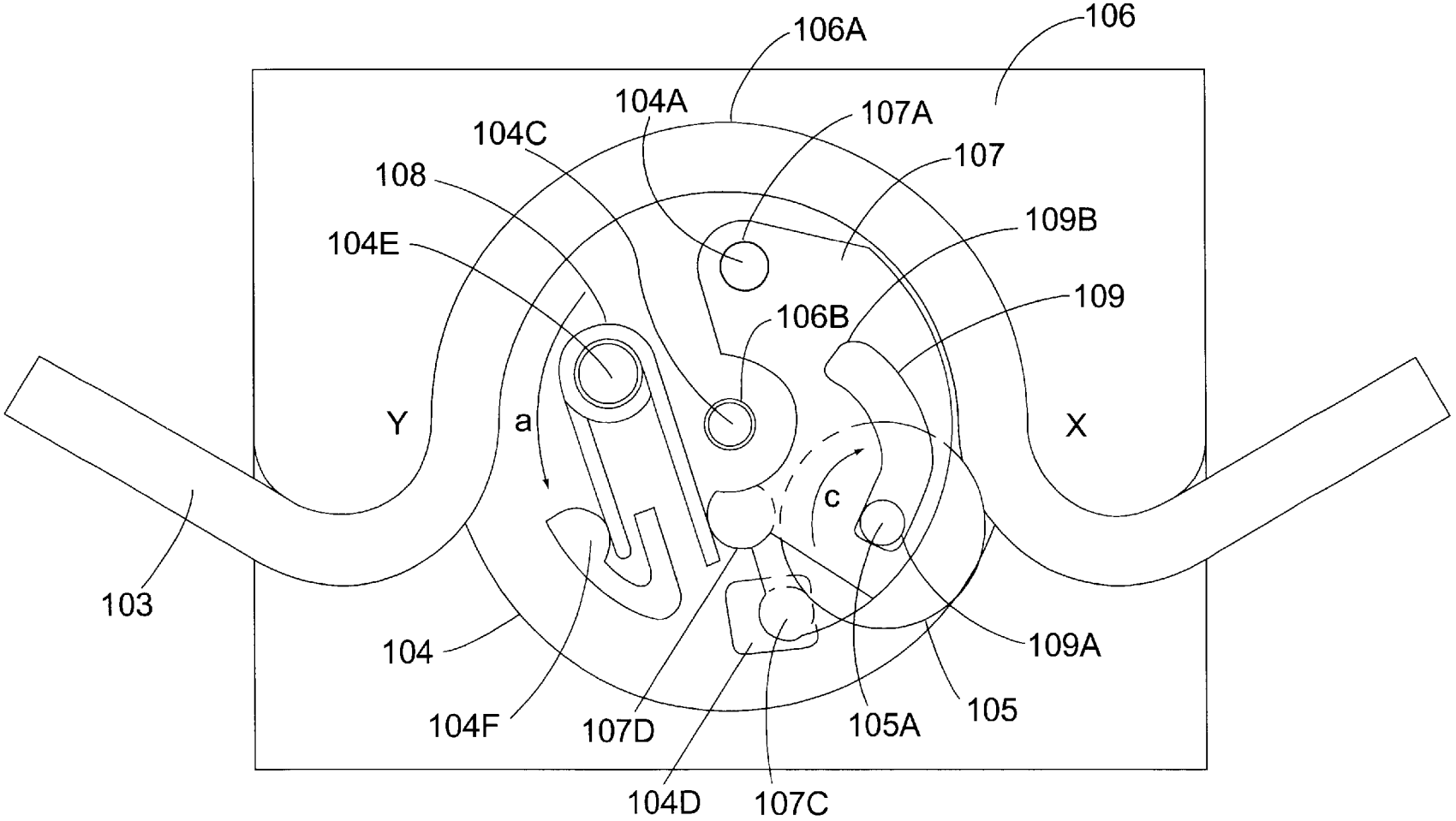
FIG. 5 is a cross section of part of lover 107 of the tube pump shown in FIG. 2, and it shows the pump in a state wherein it rotates in the direction that generates a negative pressure.
Figure 6:
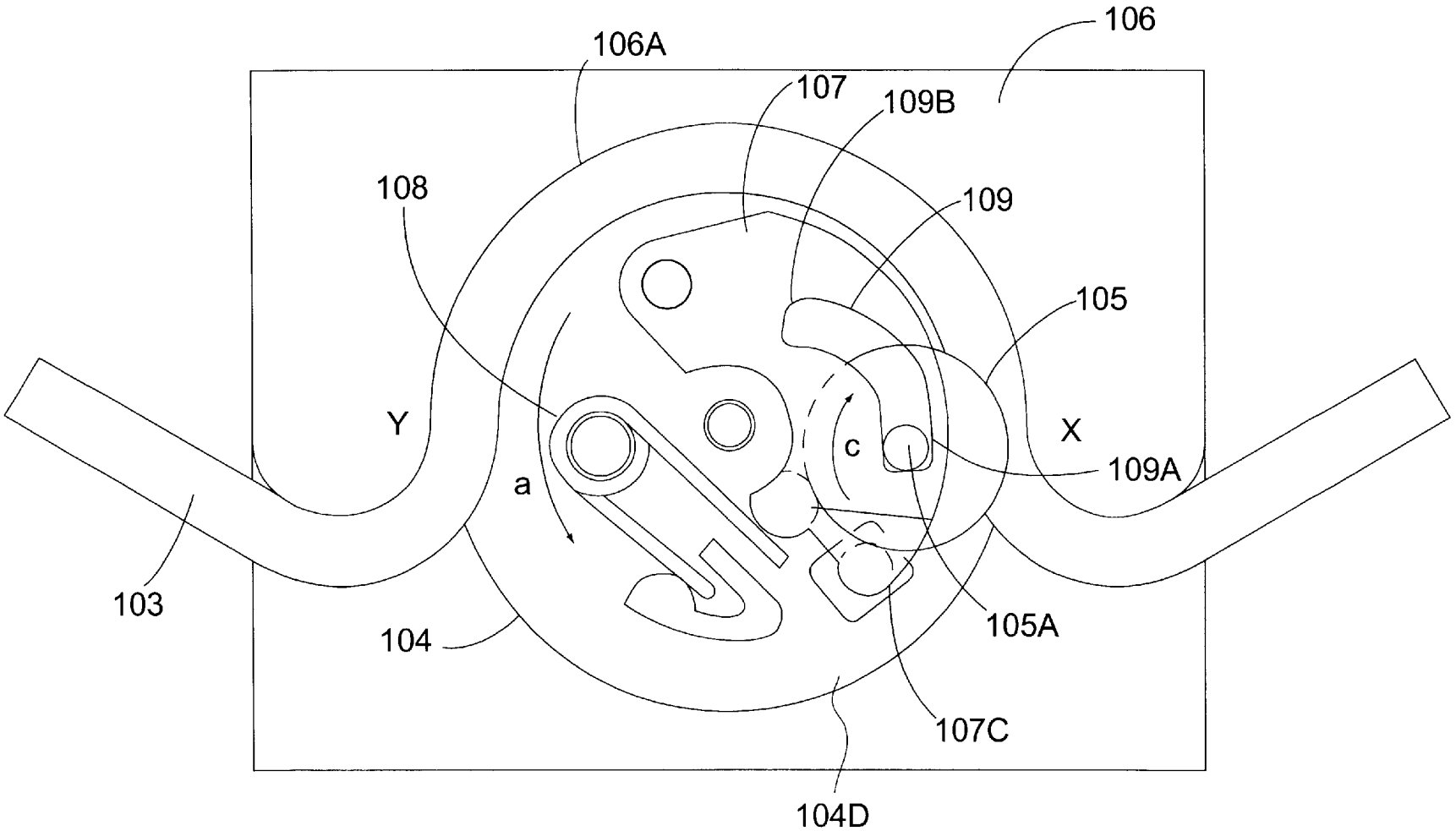
FIG. 6 is a cross section of part of lever 107 of the tube pump shown in FIG. 2, and it shows the pump in a state wherein it rotates in the direction that generates a negative pressure and roller 105 is in a position to depress and deform tube 103.
Figure 7:
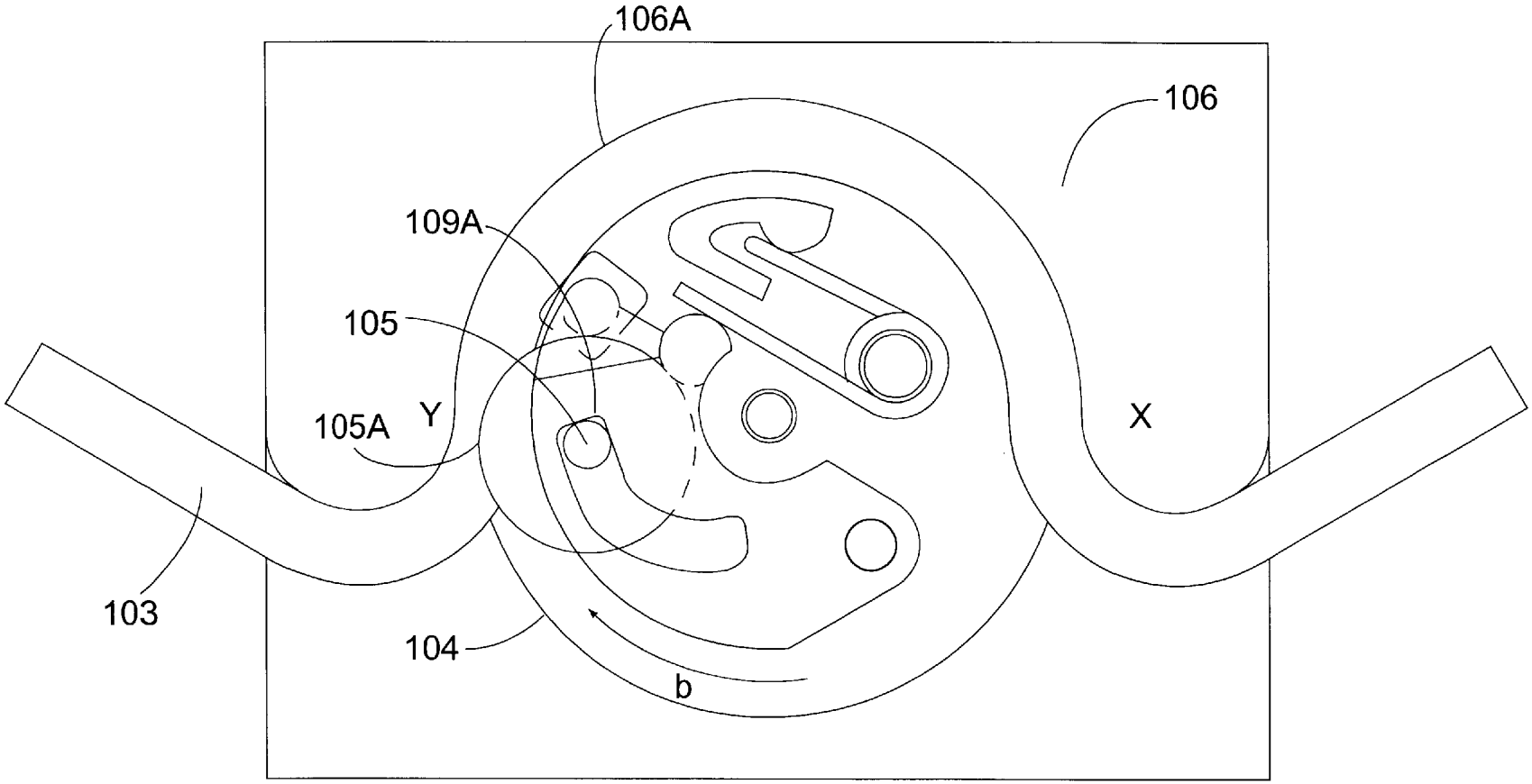
FIG. 7 is a cross section of part of lever 107 of the tube pump shown in FIG. 2, and it shows the pump in a state wherein it rotates in the reverse direction.

All of the figures FIG. 4 to FIG. 8 are cross sections of part of lever 107 of the tube pump shown in FIG. 2, where FIG. 4 shows a state wherein roller 105 is in the hold position and is separated from guide 106A and stopped, FIG. 5 and FIG. 6 show the pump rotating in the direction of arrow a (referred to as forward rotation below) which generates a negative pressure, and FIG. 7 and FIG. 8 show the pump rotating in the direction of arrow b (referred to as reverse rotation below) which is the opposite of the direction of forward rotation.

As shown in FIG. 5, when rotor plate 104 rotates in the direction of arrow a from the state in FIG. 4, roller 105 comes in contact with tube 103, and as it rotates further, roller 105 moves along cam 109 from the hold position to the operation position. As roller 105 is driven in the direction of arrow c due to the force of contact on tube 103, it gradually moves toward arc-shaped guide 106A, and at the position of X at the start of guide 106A, it depresses and deforms tube 103 until there is zero space in the tube, as shown in FIG. 6.

When rotor 104 continues to rotate from this state, a negative pressure is generated due to the change in the volume of the tube being squeezed by the roller, and suction of the nozzles is performed. Cap 17 is positioned upstream from the X position to which tube 103 is guided by the guide member, and waste ink tank 30 which stores ink is positioned downstream from the Y position.

The stop operation of the pump is explained below with reference to FIG. 7 and FIG. 8.

When the suction operation (prescribed forward rotation) required to recover the recording head to a normal condition is complete, motor 18 is stopped, which stops drive of the pump. In this state, roller 105 is at the operation position as described above, and when roller 105 is stopped between the leading end X and trailing end Y of guide 106A of the guide member, tube 103 is squeezed by roller 105 as shown in FIG. 7. When left in this state for a long period, permanent deformation of the tube, deterioration of its durability or other problems may occur as previously described.

For this reason, after forward rotation of rotor plate 104 is stopped in order to stop the pump, rotor plate 104 is rotated backwards to move roller 105 from operation position 109A to hold position 109B, and then it is stopped again.

That is, by reversing rotation (b direction) of rotor plate 104, the roller at operation position 109A (FIG. 7) is moved to hold position 109B (FIG. 8). Even if roller 105 is stopped in the X-Y interval of guide 106A as shown in FIG. 8 after reversing rotation of the rotor plate and then stopping it again, roller 105 is in a state in which it only lightly contacts tube 103. Even if the pump is continuously reversed to this state, the tube is hardly squeezed, and therefore the suctioned ink will not flow back.

The operation of roller 105 and valve 110 is explained below with reference to FIG. 10 to FIG. 12.

Figure 10:
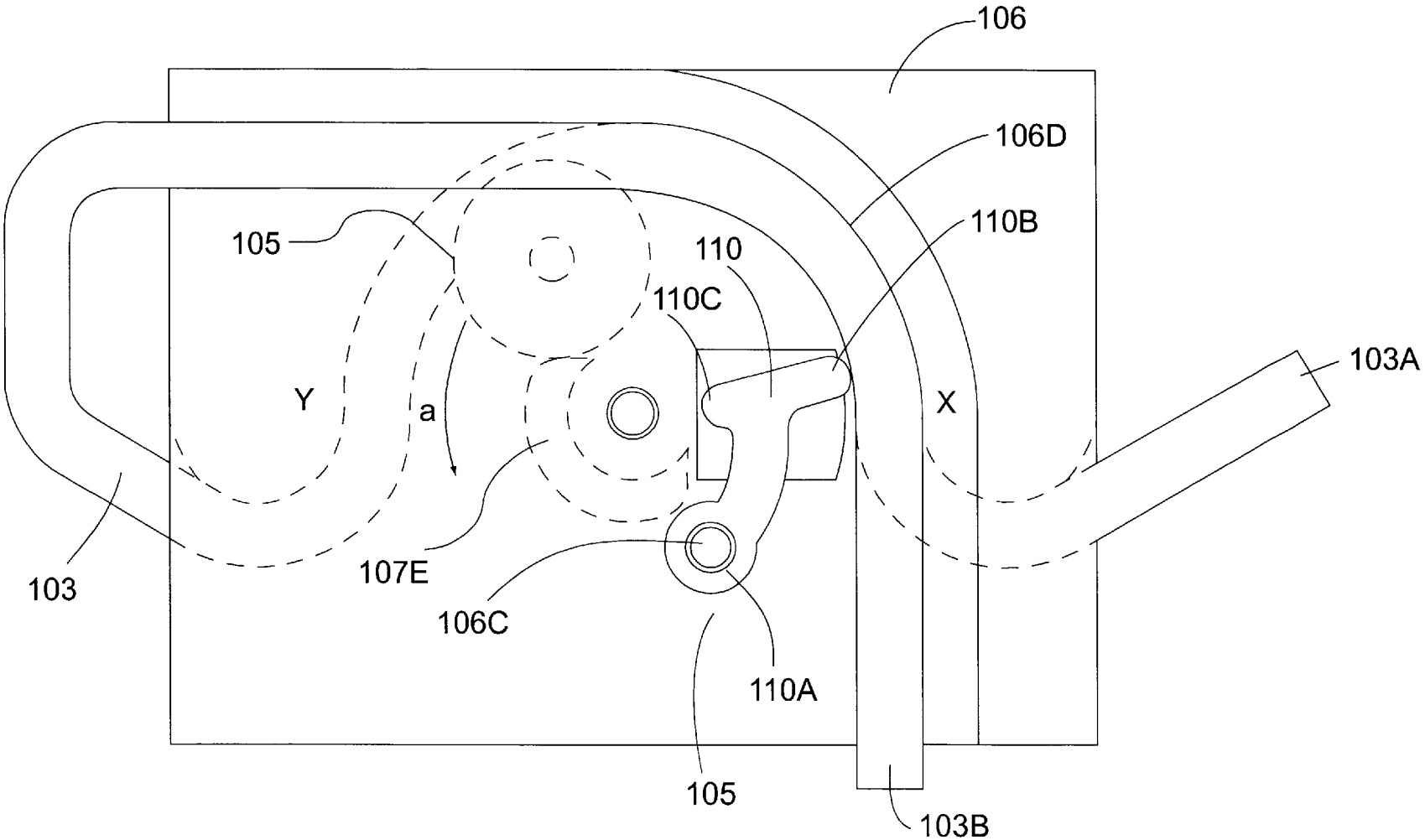
FIG. 10 is a plan view looking from the side of tube pump 15 shown in FIG. 2 on which valve 110 is attached, and it shows roller 105 between leading end X and trailing end Y of arc-shaped guide 106A.
Figure 11:
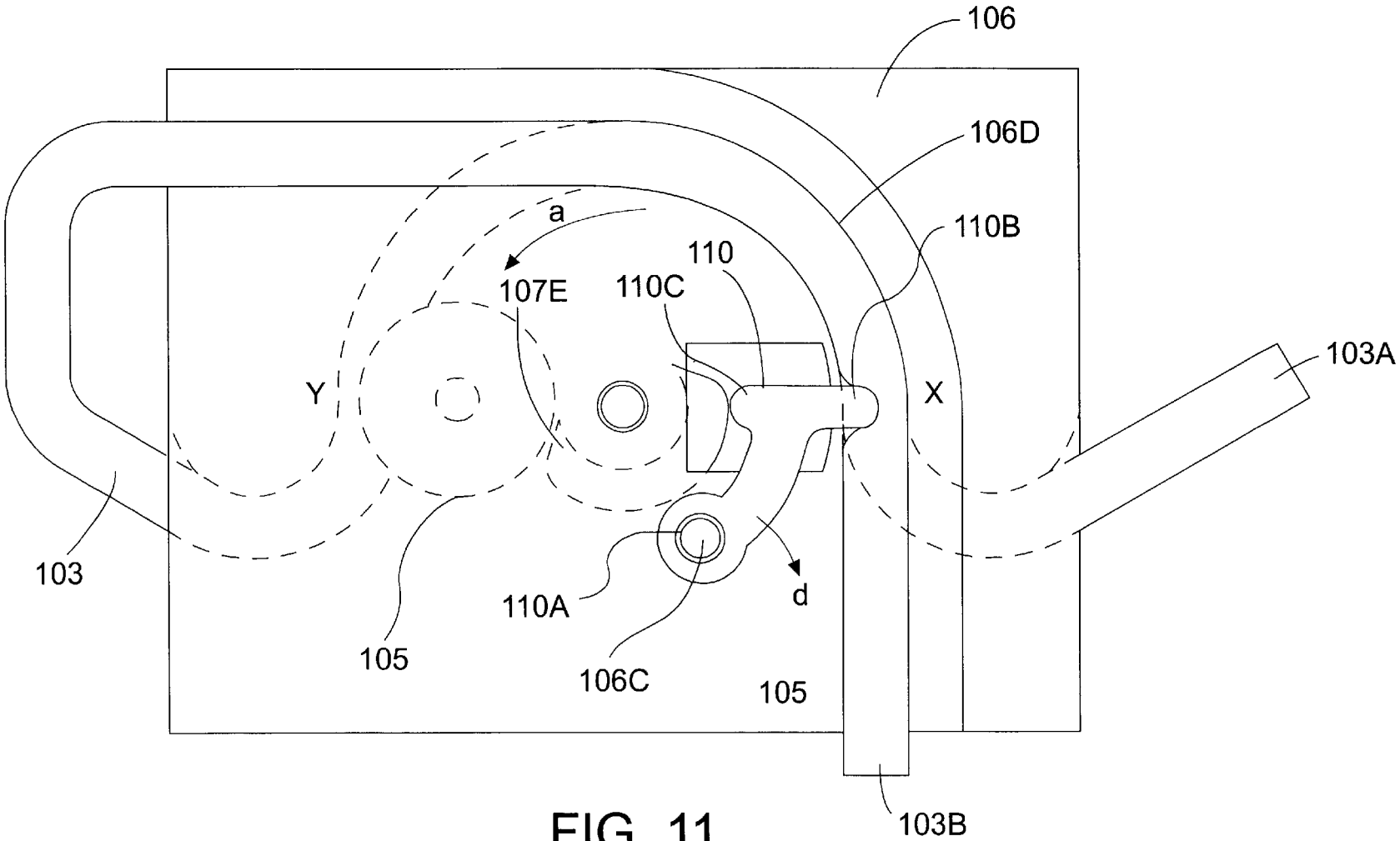
FIG. 11 is a plan view looking from the side of tube pump 15 shown in FIG. 2 on which valve 110 is attached, and it shows roller 105 at trailing end Y of guide 106A.
Figure 12:
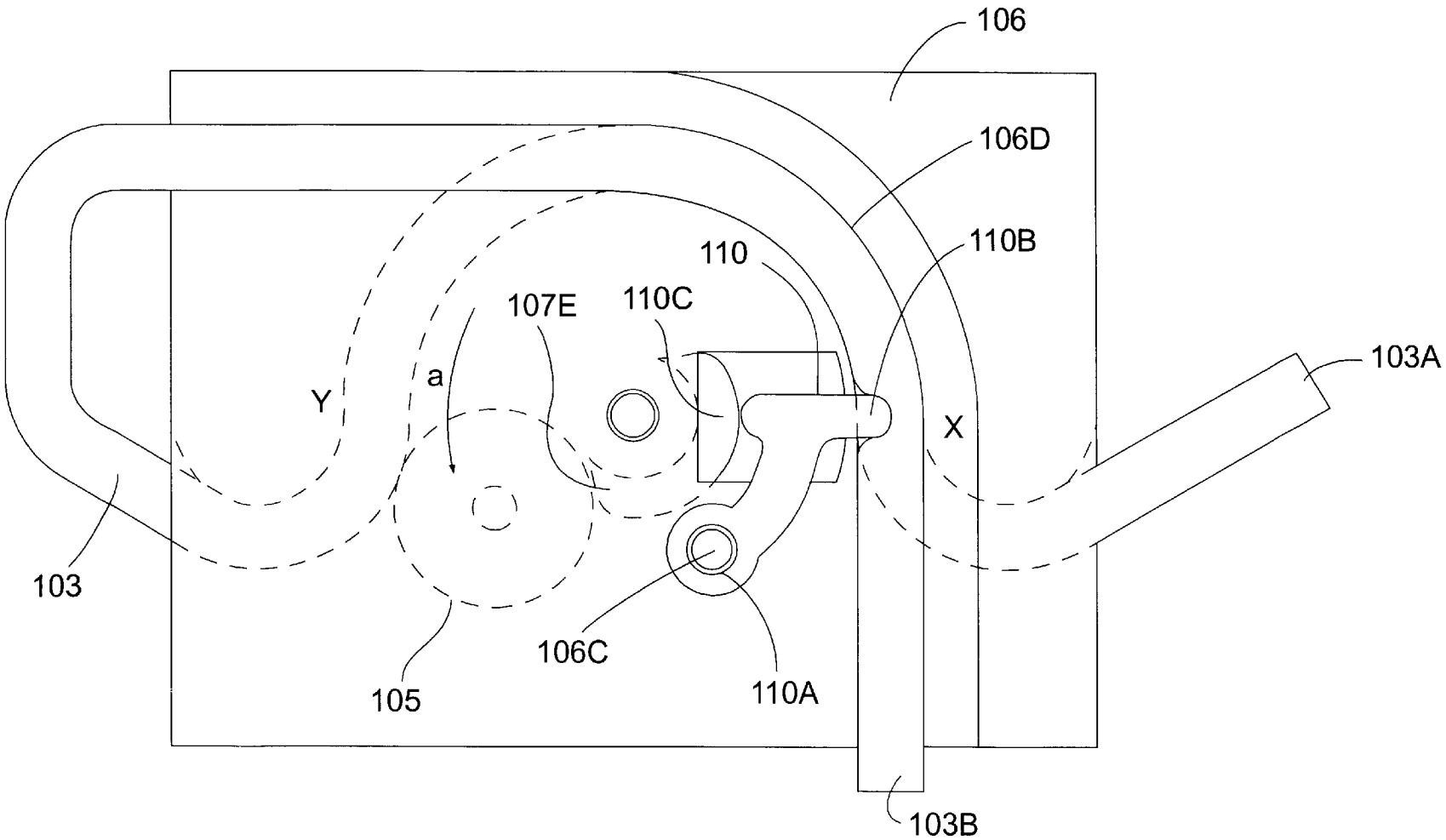
FIG. 12 is a plan view looking from the side of tube pump 15 shown in FIG. 2 on which valve 110 is attached, and it shows roller 105 separated away from guide 106A.

FIG. 10 to FIG. 12 are all plan views looking from the side of tube pump 15 shown in FIG. 2 on which valve 110 is attached, FIG. 10 shows roller 105 between leading end X and trailing end Y of arc-shaped guide 106A, FIG. 11 shows roller 105 at trailing end Y of guide 106A, and FIG. 12 shows roller 105 separated away from guide 106A.

As described above, cap 17 is connected to tube 103 on the upstream side of leading end X of guide 106A at tube end 103A. Also, tube 103 extends to this side from trailing end Y of guide 106A, is guided by guide 106D, and is connected to waste ink tank 30 disposed on the downstream side at tube end 103B.

Roller 105 shown in FIG. 10 sequentially pressurizes the tube on guide 106A as it moves in the a direction, whereby ink is suctioned from the nozzles. As shown in FIG. 12, when roller 105 passes the trailing end Y of guide 106A, it enters an area (area outside the X-Y interval on the guide) where it cannot pressurize the tube.

As shown in FIG. 11, when roller 105 reaches the trailing end of guide 106A, cam 107E disposed on lever 107 comes in contact with member 110C of valve 110, and valve 110 rotates in the direction of arrow d using shaft 106C as a pivot axis. By this mechanism, tube 103 is squeezed by end 110B of the valve and is closed off. When roller 105 reaches the leading end of guide 106A, the constraining force of cam 107E on valve 110 is released, and valve 110 returns to its original position due to the flexibility of the tube itself. That is, the closed state due to the valve is released.

The series of operations of roller 105 and valve 110 in the forward rotation of the pump described above is explained with reference to the diagram shown in FIG. 13.

Figure 13:
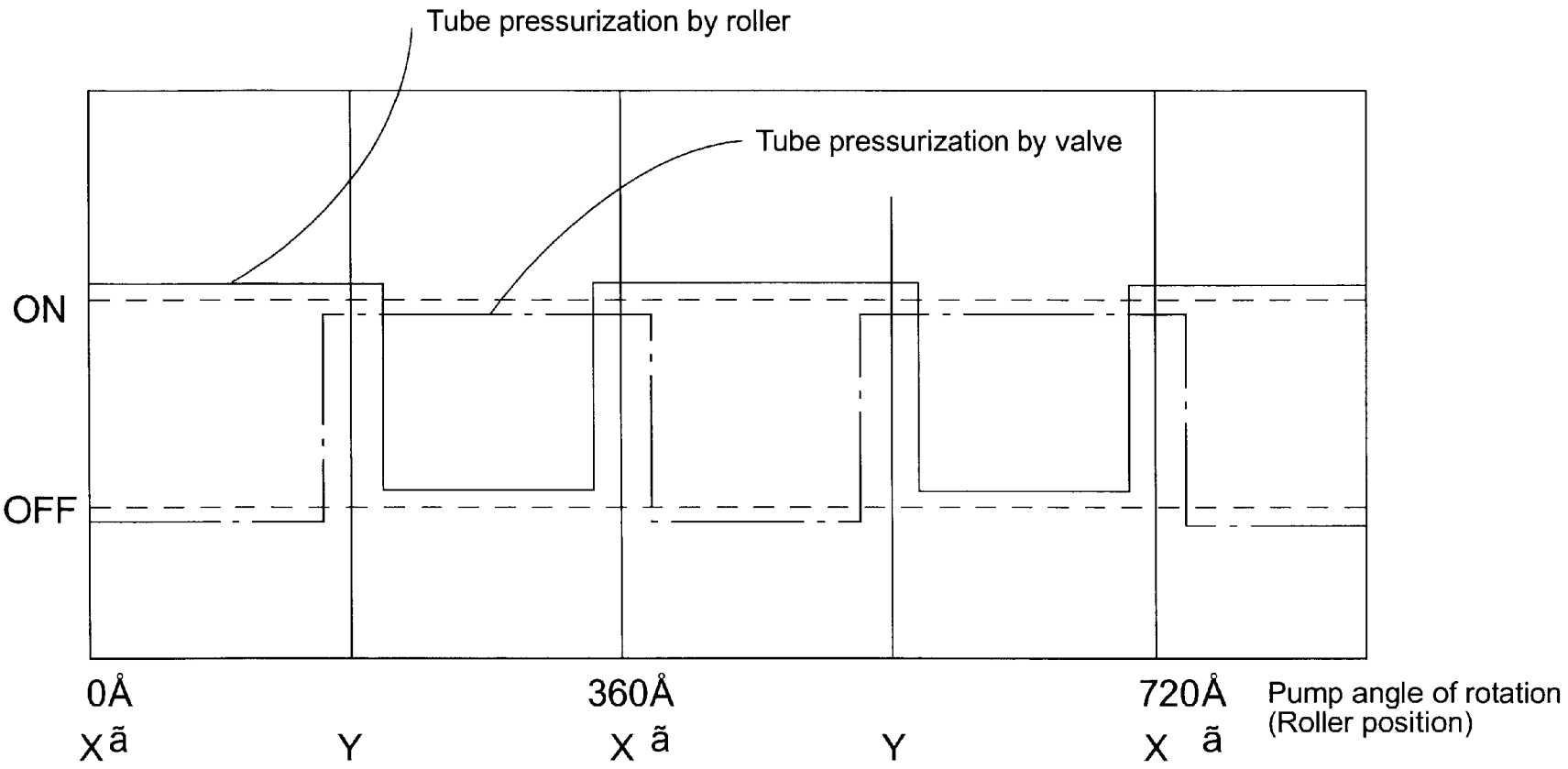
FIG. 13 is a diagram showing the relationship between the angular rotational position of the tube pump shown in FIG. 2 and the roller and valve operation.

The horizontal axis of FIG. 13 is the angle of rotation of the pump, and the vertical axis shows the ON (operation) and OFF (hold) states of tube pressurization by the roller and the valve. In the operation state of both the roller and the valve, the tube is closed, and in the hold state the tube is open. As can be seen from this diagram, at least the roller or the valve is always in contact with the tube in the pump during forward rotation, and therefore the space in the tube upstream from the pump is never open to the downstream side of the pump.

In this way, the roller squeezes the tube in the area between the X and Y positions and generates a negative pressure in the tube upstream from the pump, and when the roller is in the area outside the area between the X and Y positions, the negative pressure generated in the tube is maintained by the valve closing off the tube. Also, the roller subsequently increases the negative pressure being maintained by the valve in the area between the X and Y positions. The repetition of this operation accumulates and gradually increases the negative pressure generated by the pump from the first rotation of the pump to the second, and from the second rotation of the pump to the third, and so on.

That is, by providing this kind of valve, the efficiency of the pump is not decreased due to a drop in the negative pressure when the roller passes the position where it can no longer press against the tube. Also, since this makes only one roller necessary as opposed to a tube pump with a plurality of rollers, the pump can be made much more compact.

In this embodiment, valve 110 is disposed downstream from the area X-Y of the tube squeezed by the roller, but it can be disposed upstream (cap side) as well and achieve the same effect.

Since the part of tube 103 squeezed by valve 110 can be softer and narrower than the part squeezed by roller 105, the urging force used by valve 110 to squeeze the tube can be even smaller, thus making it possible to lower the drive torque of the pump.

Another embodiment of the present invention with a pump that uses two rollers is described with reference to FIG. 14 to FIG. 16.

Figure 14:
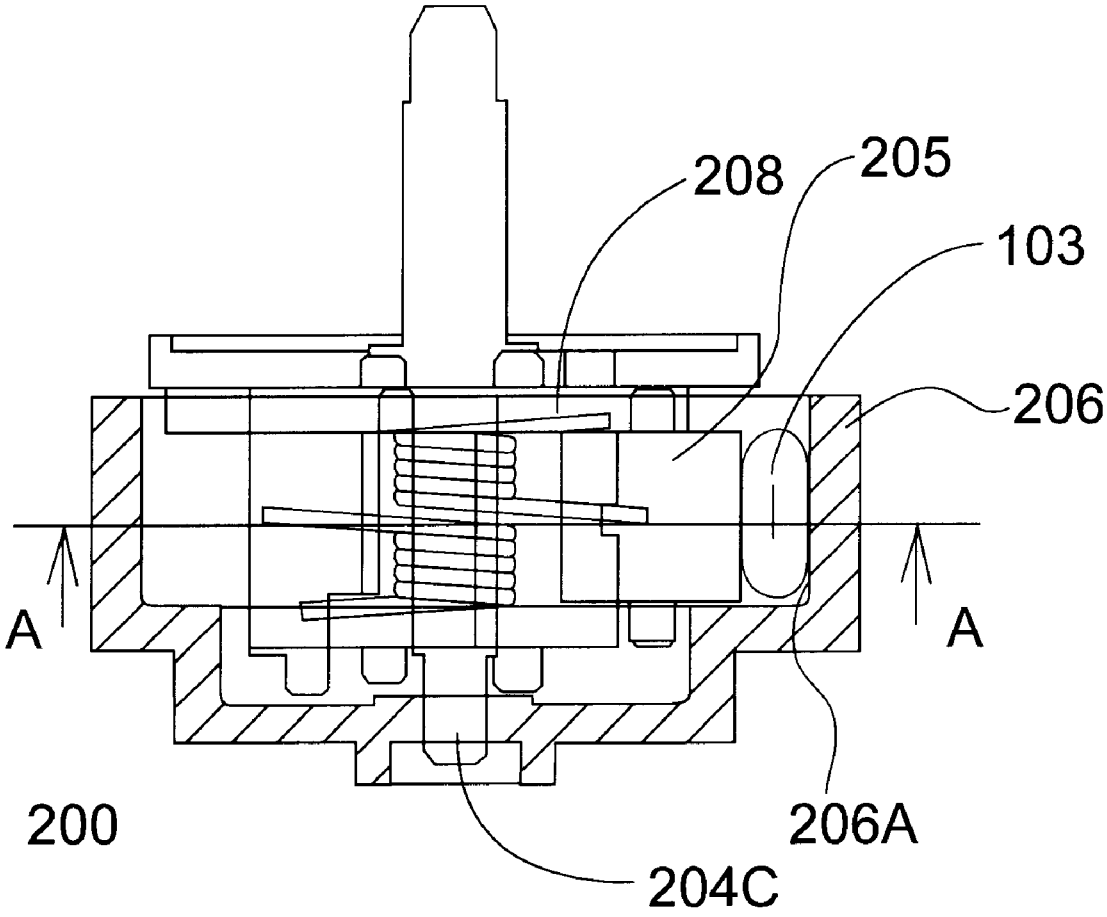
FIG. 14 is a plan view looking from the side of a tube pump of another embodiment of the invention.
Figure 15:
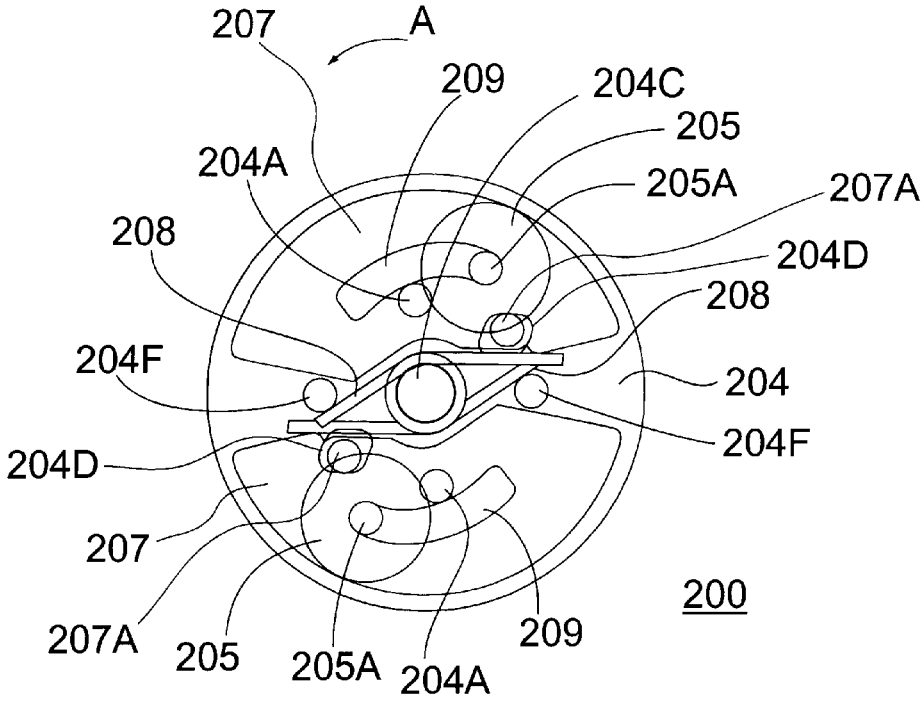
FIG. 15 is a cross section of section A—A in FIG. 14 and shows a state wherein rollers 205 are in the operating position.
Figure 16:
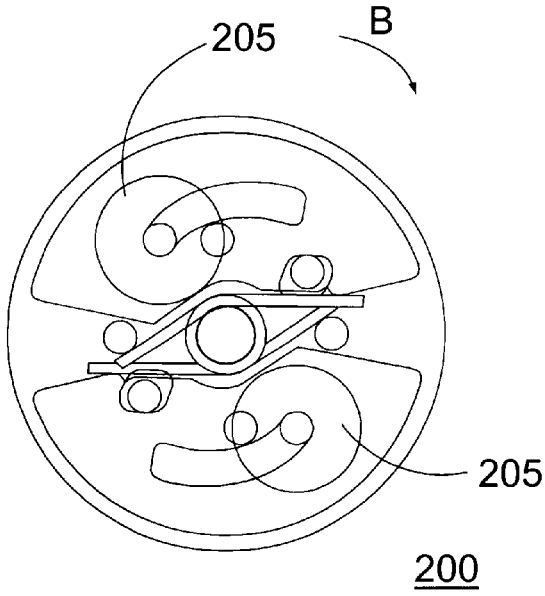
FIG. 16 is a cross section of section A—A in FIG. 14 and shows a state wherein rollers 205 are in the hold position.

FIG. 14 is a cross section looking from the side of the tube pump of another embodiment of the invention, and FIG. 15 and FIG. 16 show the A-A section of FIG. 14. FIG. 15 shows a state wherein roller 205 is in the operation position, and FIG. 16 shows a state wherein roller 205 is in the hold position.

Tube pump 200 comprises a pair of rollers 205, a pair of levers 207 to support rollers 205, rotor plate 204 to support each lever 207 such that each lever can pivot, two springs 208 to bias each lever 207 to the outside independently, and cylindrical shaped guide member 206 which supports rotor plate 204 such that it can rotate. Arc-shaped guide surface 206A for guiding tube 103 is formed on the inside wall of cylindrical-shaped guide member 206.

Each lever 207 is attached such that it can pivot with respect to rotor plate 204 using a shaft 204A disposed on rotor plate 204 as a pivot axis. Each lever 207 is disposed such that it has point symmetry with respect to shaft 204C of rotor plate 204. The two protrusions 204F are formed on rotor plate 204, and each spring 208 is attached between protrusions 204F and levers 207. Though two springs which urge each lever 207 independently are used in this embodiment, one spring that urges both levers 207 in the open direction can be used in order to make the pressure applied by each roller 205 equal.

Levers 207 are attached such that shafts 205A of rollers 205 rotate in groove-shaped cams 209 of levers 207. By this mechanism, each roller 205 moves to the operation position (FIG. 15) when rotor plate 204 rotates forward (direction of arrow A) and to the hold position (FIG. 16) when it rotates in the reverse direction (direction of arrow B). The mechanism for this movement is the same as in the previous embodiment, and therefore a detailed explanation is omitted.

Also, stopper pins 207C for inhibiting the pivot movement of levers 207, biased to the outside within a prescribed range, are disposed on the surface of each lever 207 toward rotor plate 204. When the rollers are in the hold position, the pivotal movement of each lever 207 is restricted to a fixed amount by stopper pins 207C coming in contact with the side walls of holes 204D disposed in rotor plate 204.

As described above, the two rollers are disposed such that they have point symmetry with respect to shaft 204C of rotor plate 204. Since guide surface 206A, upon which tube 103 is mounted, is formed over more than about 180 degrees on the inside wall of guide 206, one or the other roller is always positioned on the surface of guide surface 206A. For this reason, the valve described in the previous embodiment is not required in this embodiment. Also, a more efficient pump can be offered through the use of two rollers.

As described above, since the present invention effects how much the roller squeezes (intrudes on) the tube by the elastic force of the spring, increases in the drive torque of the pump due to fluctuations in the part accuracy and assembly accuracy can be avoided and a pump with low drive torque can be achieved. This makes it possible to realize a compact, low-cost drive motor.

Since the roller moves to the operation position where it sequentially squeezes the tube and to the hold position where the pressure of the roller is released depending on the direction of the rotor plate, plastic deformation or deterioration of the tube can be avoided when the pump is stopped.

Therefore, a low-cost, low-drive torque, compact and long-life pump can be obtained.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A pumping apparatus comprising:

a casing defining an internal guide surface;

a rotor rotatively mounted in said casing;

a tube partially disposed on said guide surface;

a roller for sequentially pressurizing and deforming said tube on said guide surface;

a lever pivotally mounted on said rotor and having a roller support for supporting said roller, said roller support allowing said roller to shift relative to said lever between a first position where said roller closes said tube and a second position where said roller opens said tube; and a spring for biasing said lever toward said guide surface.

2. A pumping apparatus according to claim 1, wherein said roller moves to said first position when said rotor rotates in a first direction, and moves to said second position when said rotor rotates in a second direction opposite to said first direction.

3. A pumping apparatus according to claim 1, further comprising a stopper for preventing pivotal motion of said lever biased by said spring beyond a predetermined position, said stopper arranged to stop said lever at said predetermined position when said roller is in said second position.

4. A pumping apparatus according to claim 1, wherein a shaft of said roller is guided in a guide groove provided in said lever, said roller being shiftable along said guide groove.

5. A pumping apparatus according to claim 1, further comprising a valve for closing said tube when said roller is moved to said second position.

6. A pumping apparatus according to claim 1, comprising a plurality of rollers and a plurality of levers, each lever pivotally mounted on said rotor and having a roller support for independently supporting a respective roller.

7. A pumping apparatus according to claim 6, further comprising a plurality of springs, each spring independently biasing a respective lever toward said guide.

8. A pumping apparatus according to claim 6, having a common spring for biasing said plurality of levers toward said guide.

9. An ink-jet recording apparatus comprising:

a nozzle for ejecting ink droplets; and a pump provided in an ink supply path leading to said nozzle or a discharge path leading from said nozzle, said pump comprising;

a casing defining an internal guide surface;

a rotor rotatively mounted in said casing;

a tube partially disposed on said guide surface;

a roller for sequentially pressurizing and deforming said tube on said guide surface;

a lever pivotally mounted on said rotor and having a roller support for supporting said roller, said roller support allowing said roller to shift relative to said lever between a first position where said roller closes said tube and a second position where said roller opens said tube; and a spring for biasing said lever toward said guide surface.

10. An ink-jet recording apparatus according to claim 9, wherein said roller moves to said first position when said rotor rotates in a first direction, and moves to said second position when said rotor rotates in a second direction opposite to said first direction.

11. An ink-jet recording apparatus according to claim 9, further comprising a stopper for preventing pivotal motion of said lever biased by said spring beyond a predetermined position, said stopper arranged to stop said lever at said predetermined position when said roller is in said second position.

12. An ink-jet recording apparatus according to claim 9, wherein a shaft of said roller is guided in a guide groove provided in said lever, said roller being shiftable along said guide groove.

13. An ink-jet recording apparatus according to claim 9, further comprising a valve for closing said tube when said roller is moved to said second position.

14. An ink-jet recording apparatus according to claim 9, comprising a plurality of rollers and a plurality of levers, each lever pivotally mounted on said rotor and having a roller support for independently supporting a respective roller.

15. An ink-jet recording apparatus according to claim 14, further comprising a plurality of springs, each spring independently biasing a respective lever toward said guide.

16. An ink-jet recording apparatus according to claim 14, having a common spring for biasing said plurality of levers toward said guide.

* * * * *